US005138227A

United States Patent [19]

Heider et al.

[11] Patent Number: 5,138,227

[45] Date of Patent: Aug. 11, 1992

[54] HIGH-PRESSURE DISCHARGE LAMP, PARTICULARLY DOUBLE-ENDED HIGH-POWER, HIGH-WALL LOADING DISCHARGE LAMP, AND METHOD OF MAKING THE SAME

[75] Inventors: Jürgen Heider; Achim Gosslar, both of Munich, Fed. Rep. of Germany

[73] Assignee: Patent Treuhand Gesellschaft fur Elektrische Gluhlampen m.b.H., Munich, Fed. Rep. of Germany

[21] Appl. No.: 500,760

[22] Filed: Mar. 28, 1990

[30] Foreign Application Priority Data

Apr. 4, 1989 [DE] Fed. Rep. of Germany ..... 3910878

[51] Int. Cl.[5] ..... H01J 61/36; H01J 61/30

[52] U.S. Cl. ..... 313/623; 313/332; 313/634; 313/640; 445/26

[58] Field of Search ..... 313/623, 332, 640, 634; 445/26

[56] References Cited

U.S. PATENT DOCUMENTS

| | | | |
|---|---|---|---|
| 2,924,731 | 2/1960 | Martt . | |
| 3,654,506 | 4/1972 | Kuhl . | |
| 3,842,307 | 10/1974 | Dobrusskin et al. | 313/640 X |
| 4,254,356 | 3/1981 | Karikas | 313/623 |
| 4,389,201 | 6/1983 | Hansler et al. | 445/26 |
| 4,396,857 | 8/1983 | Danko | 313/634 |
| 4,647,814 | 3/1987 | Dobrusskin et al. | 313/641 |
| 4,686,419 | 8/1987 | Block et al. | 313/641 |
| 4,749,902 | 6/1988 | Weiss | 313/332 |
| 4,983,889 | 1/1991 | Roberts | 313/641 X |

FOREIGN PATENT DOCUMENTS

| | | | |
|---|---|---|---|
| 159620 | 10/1985 | European Pat. Off. . | |
| 2619505 | 11/1976 | Fed. Rep. of Germany . | |
| 3319021 | 1/1983 | Fed. Rep. of Germany . | |
| 2620267 | 3/1939 | France . | |
| 55-19732 | 2/1980 | Japan . | |
| 51457 | 3/1983 | Japan | 313/623 |
| 58-51457 | 3/1983 | Japan . | |
| 694919 | 10/1979 | U.S.S.R. | 313/640 |
| 963119 | 9/1982 | U.S.S.R. . | |

OTHER PUBLICATIONS

"Designers Handbook Light Source Applications" by Waymouth et al, p. 41, Sylvania/GTE, 1980.

"Technisch-wissenschaftliche Abhandlungen der OSRAM Gesellschaft"(Technical-Scientific Publications of the OSRAM company). vol. 11, pp. 163 et seq., article by Lewandowski New OSRAM-HMI ® Lamps for Folor Film and Color Television Filming; vol. 12, pp. 83 et seq., article by Dobrusskin and Leyendecker Halogen Metal Vapor Lamps with Rare Earths.

*Primary Examiner*—Palmer C. DeMeo

*Attorney, Agent, or Firm*—Frishauf, Holtz, Goodman & Woodward

[57] ABSTRACT

To reduce the axial length of high-power, high-pressure discharge lamps, for example between 1000–4000 W rating, while reducing the temperature, in operation, of a connection foil (8) adjacent the base ends of the foil, the discharge vessel (2) of quartz glass has two shaft-like extensions (5) unitary therewith, in which the connection foils are pinch or press-sealed. The lengths of the pinch or press seals are major fractions of the length of the discharge of the discharge vessel, for example between 2/3 and 4/3 thereof, and the connection foil extends over a major portion of the length of the shaft-like extension, for example between 60–80%. Such pinch seals are made by differentially, over its length, heating the shaft-like extension (5).

30 Claims, 3 Drawing Sheets

HIGH-PRESSURE DISCHARGE LAMP, PARTICULARLY DOUBLE-ENDED HIGH-POWER, HIGH-WALL LOADING DISCHARGE LAMP, AND METHOD OF MAKING THE SAME

Reference to related patents, the disclosures of which are hereby incorporated by reference, assigned to the assignee of the present application:

U.S. Pat. No. 4,86,419, BLOCK et al;

U.S Pat. No. 4,647,814, DOBRUSSKIN et al.

Reference to related publications:

German Patent Disclosure Document 26 19 505, Taxil et al;

European Published Patent Application 0 159 620, Reilling et al;

German Patent Disclosure Document DE-OS 33 19 021;

"Technisch-wissenschaftliche Abhandlungen der OSRAM-Gesellschaft" ("Technical-Scientific Publications of the OSRAM company"), published by Springer:

Vol. 11, page 163 et seq., article by Lewandowski "New OSRAM-HMI ® Lamps for Color Film and Color Television Filming";

Vol. 12, page 83 et seq., article by Dobrusskin and Leyendecker "Halogen Metal Vapor Lamps with Rare Earths".

Field of the Invention

The present invention relates to a method to make, and to high-pressure discharge lamps, and more particularly to a high-pressure discharge lamp which is double-ended, that is, is an elongated structure having terminals projecting therefrom at either end, and which include a fill of mercury, a metal halide and a starting gas, and especially to lamps having high power rating in the order of at least about 1000 W and up to, for example, about 4000 W. Such lamps have high-wall loading, in the order of between about 30–60 W/cm$^2$.

BACKGROUND

High-power lamps, to which the present invention relates, are to be considered lamps which operate in a power range of, for example, roughly 1000–4000 W, with a wall loading of 30–60 W/cm$^2$. Lamps of this type are frequently used for intense illumination systems, e.g. for theatrical stages, to record scenes on film and for television, and for search lights or projection purposes. These lamps are usually coupled to optical systems, such as reflectors and lenses.

U.S. Pat. No. 4,686,419, Block et al, assigned to the assignee of the present application and the disclosure of which is hereby incorporated by reference, describes a high-pressure discharge lamp with a metal halide fill suitable for association with an optical system. These lamps, usually, have only a single bulb, that is, they are not covered by an outer bulb or cover element, in order to avoid, or at least minimize distortions arising in the optical system. Further, the electrode spacing of the discharge electrodes is as short as possible, for example in the order of about 3 cm. The discharge vessel is made of quartz glass, from which elongated and comparatively long cylindrical electrode shafts extend. Rather long molybdenum foils are melt-connected into the electrode shafts or extension. The lamps are complex to make and not subject to mass production; they are, each, made manually. When the lamp is operating, the temperature at the ends of the connecting foils which are r closest to the bases of the lamp must be below 400° C. Due to the lack of an outer bulb, these ends are exposed to the oxygen in the air which tends to oxidize the lamp components, and thus limit the lifetime of the entire lamp. The melt-in technology for the long foils is complex, and thus the lamps become very expensive. Additionally, the lamps have a low lifetime, of about only 250 hours.

An additional disadvantage of these lamps occurs in operation, namely the relatively high electrical resistance of the long molybdenum foils results in high electrical losses in high power lamps. At 400° C., these foils may have a resistance of about 0.043 ohms. The resulting electrical losses lead to heating of the lamp bulb extensions, which form the connecting shafts, and further contribute to reduction of the light output of the lamps. The light output of a typical lamp is in the order of about 80 1 m/W.

The unsatisfactory efficiency and the large dimensions of the lamps can be accepted for specialty applications, where their otherwise excellent characteristics outweigh the disadvantages. For other applications, however, particularly for outside illumination, where the lamps are exposed to wind loading, for example, their use was, heretofore, not justified.

A similar lamp, which also had a lifetime of only about 250 hours, but of even higher power, in the order of 4–12 kW, is described in U.S. Pat. No. 4,647,814, Dobrusskin et al; this lamp is described in detail, further, in the referenced "Technical-Scientific Publications of the OSRAM Company", which is a related company of the assignee of the present application. These publications are commercially available from the Springer Publishing Company.

It has previously been proposed, see German Patent Disclosure Document DE-OS 26 19 505, to limit the temperature of the lamps in the region of the bases to about 350° C. by placing a plurality of gas-filled hollow spaces between the melt connection of the electrode and the base itself. Another arrangement is shown in German Patent Disclosure Document DE-OS 33 19 021 to reduce the temperature of the lamp extension or lamp shaft by forming the end surface of the electrode melt-in not as a flat and mirror surface but, rather, in funnel or conical shape. The melt-in extension in this lamp is a solid cylinder. Forming the end surface conically avoids back reflection from the previously known flat surface, which somewhat reduces the temperature loading of the lamp connecting extension. A full cylindrical lamp shaft acts like a light guide into which heat and light from the discharge volume is transmitted and coupled, resulting in heat transmission problems by the light shaft itself. In spite of the conical end surface, a 2500 W lamp still requires lamp shafts of about 11 cm length.

A metal halide high-pressure discharge lamp suitable for general illumination is described in European Published Application EP-OS 159 620. This lamp has high efficiency and includes an outer envelope or a second outer bulb. Placing a second outer bulb about the lamp substantially reduces the problem of oxidation due to oxygen in the air and permits a lifetime of several thousand hours; such a lamp is not, however, suitable for association with optical systems since the outer envelope or bulb substantially degrades the optical quality thereof. The bulb extensions or bulb shafts holding the electrodes can be reduced in length and they can be made in pinch or press technology, which can be carried out readily by machinery, and hence are relatively inexpensive. Yet, the temperature at the end of a pinch seal is substantially higher than 350° C. This does not matter in a double-bulb lamp due to the atmosphere between the discharge vessel or discharge bulb and the outer envelope or surrounding bulb, which atmosphere may be inert or, effectively, may be absent, that is, the space between the discharge vessel and the outer bulb may be evacuated. The electrode spacing is substantial, in the order of about 10 cm. The lamp operates with high supply voltages, of about 380 V, and provides light output similar to the previously described single bulb lamps, namely about 85 1 m/W of the overall system. The lamp cannot be used effectively for optical applications where the lamp must cooperate with optical systems, such as a reflector, curved mirror or the like, due to the dual-envelope or bulb structure and the long arc length. The short overall construction length of the lamp results, however, in low wind loading so that this lamp is suitable for floodlights, outside illumination of buildings, monuments and the like.

THE INVENTION

It is an object to provide a lamp suitable for optical applications, that is, for association with an optical system, which, additionally, has high efficiency, small dimensions, can be made by machine, and, additionally, is suitable for external or outside use, for example for outside flood lights o lighting of buildings; and to a method of its manufacture.

Briefly, the lamp is a single discharge vessel or bulb element which has a unitary discharge vessel of high temperature resistant light transmissive material from which two shaft-like extensions project. Preferably, the discharge vessel is similar to an ellipsoid. Two electrodes are located within the vessel and secured in position in the shaft-like extension, the ends of which carry bases through which current connection elements extend, coupled to connection foils which, in turn, are connected to the electrodes within the discharge vessel. In accordance with a feature of the invention, an arrangement is provided to reduce the foil temperature in operation of the lamp, and particularly adjacent the base, to maintain a temperature adjacent the base of not over about 350° C. A pinch or press seal is formed on the shaft-like extension, the pinch or press seal having a length which is related to the length of the discharge vessel to be a major portion thereof, for example between two thirds to four thirds of the length of the discharge vessel; further, the lengths of the connection foils extend over the major portion of the length of the shaft-like extension.

The lamp in accordance with the present invention has a very high light output, over 100 1 m/W with a high lifetime. Since the temperature of the shaft-like extensions, where the foils are close to the base ends, is at the maximum of 350° C., when the lamp and base are assembled together, the lifetime is extended to up to about 1500 hours and more. The pinch or press seal, additionally, has the advantage that the light guide effect is practically eliminated. This light guide effect forced increase of the length of cylindrical melt connections, so that, since the effect is no longer a problem, the overall length of the lamp can be reduced so that, with respect to prior art lamps, the lengths of the connecting shafts or extensions can be reduced by 50% and more.

Various experiments were made to obtain optimum conditions for a lamp by weighing the parameters of current loading, length of foil, thickness of foil, and geometry of the discharge vessel, and arranging them by making suitable adjustments. Use of the pinch or press seal technology, and applied to high-pressure high-power discharge lamps, proved to be the key to success. The lamp extensions or shafts are substantially shorter than in prior art lamps, which permits constructing the entire lamp much smaller and, hence, permits fixtures, fittings and optical systems within or with which it is to be installed to be reduced. This also permits use of the lamp for floodlights search lights and the like, where, in outdoor installations, lowered wind resistance is obtained, a substantial advantage in such environments.

The extensions of the lamp bulb, which form the shaft-like housings for the foils, are substantially longer than the lamp shafts previously made by pinch or press seal technology. This requires high precision in the formation of the pinch or press seal. Two gas burners which rotate about the glass shaft, typically a quartz glass shaft, are controlled to generate a highly uniform pinch temperature of about 2300° C., with variations of only ±50° C. This can be obtained by suitable control of the profile of the gas flame, for example by providing four rows of gas nozzles with different bore or nozzle diameters. Higher temperature differences might lead to stresses within the lamp shaft which, again, will lead to problems such as poor embedding of foils, which might result in a reject or in early failure of the lamp. The portion of the electrode embedded in the pinch seal can advantageously be kept very short, for example, only 3 mm. This reduces further the problem of cold spot and stabilizes the color temperature and the maintenance and enhances the luminous efficiency.

DRAWINGS

DETAILED DESCRIPTION

Figure 1:
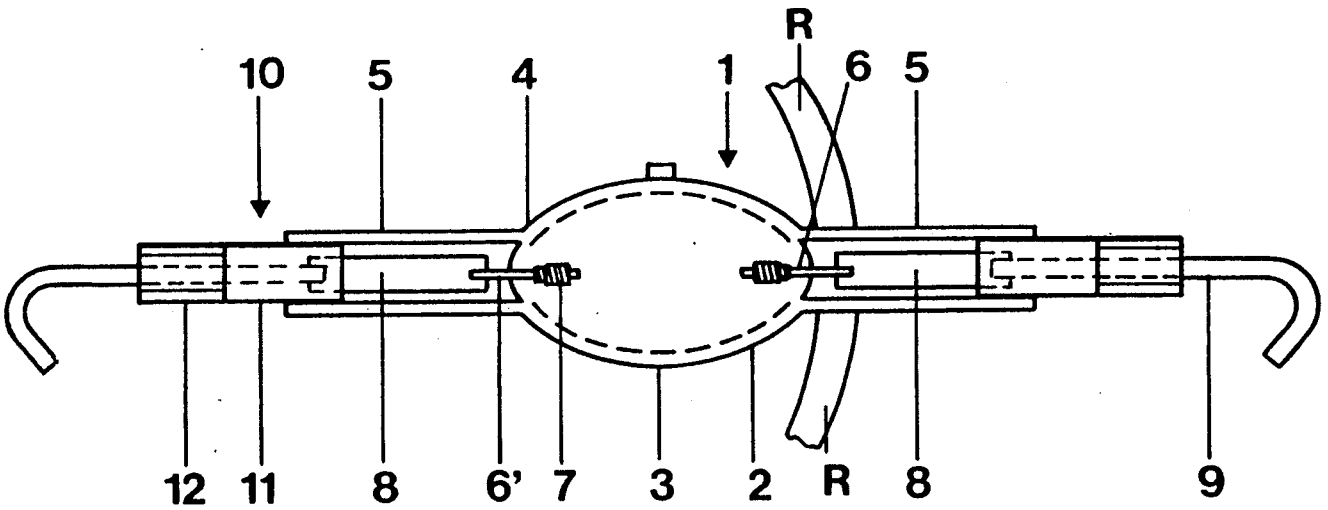
FIG. 1 is a highly schematic side view of a 2000 W high-pressure discharge lamp.

A high-pressure discharge lamp 1 of 2 kW rating and an overall length of 19 cm is adapted to be associated with a reflector R, shown only schematically, and representing an optical system. The lamp is fitted in the reflector R in axial direction, which makes short length of the lamp of substantial importance, see for example, also FIG. 3 of the referenced U.S. Pat. No. 4,686,419. The discharge vessel 2 is made of quartz glass; it is quite close to an isothermal vessel; the wall thickness of the quartz glass is about 2 mm, or may be 2.5 mm. The overall structure is essentially barrel shaped, with a generatrix having a radius of 38.25 mm. The wall thickness in the central region 3 of the barrel-shaped vessel 2 is thicker than at the end portions 4, and increases, from the end portions, to about 3 mm. The wall loading, due to the convection bending of the discharge arc, is the highest in the central region 3, about 50 W/cm$^2$. The largest outside diameter of the discharge vessel is 36 mm, and its axial length about 51 mm. The outer diameter at the ends 4 of the barrel, to which, at each end, a connecting shaft-like extension 5 is unitarily joined, is about 16 mm. The overall discharge volume will be about 20 cm$^3$. The electrodes 6, which are rod-like, are made of tungsten and are spaced from each other with tip-to-tip distance of 30 mm. They are held axially in the lamp shaft-like extensions 5, and, close to the electrode tips, have a double layer winding 7 wound thereover.

In accordance with a feature of the invention, the electrodes 6 are connected via molybdenum foils 8 to massive current supply connection elements 9, the molybdenum foils 8 being vacuum-tightly located within a double-T-shaped (or I-shaped) pinch seal covering the entire shaft-like extension 5. The pinch seal, thus, will be essentially flat, with internal ridges. The molybdenum foils 8 are melted into the pinch seals. The shaft-like extensions 5 have a length of about 40 mm, and a width of about 16 mm. The molybdenum foils 8, which are etched in lensatic form, have a central maximum thickness of about 0.05 mm, a length of about 30 mm, and a width of about 8 mm.

In general, the length of any one of the shaft-like extensions 5 is preferably between about 2/3 and 4/3 of the length of the discharge vessel 1 between its ends 4. The lengths of the extensions 5 thus are a major portion of the vessel 1 and extension 5 combination. The length of the portion 6' of the electrode between the foil 8 and the discharge volume is only 3 mm.

A ceramic sleeve-like base is secured to the shaft-like extension 5 at the remote end by a suitable cement. The ceramic shaft 10 comprises a slit cylindrical holding portion 11 and a flattened end portion !2 adapted to face the holding and connecting fixture or socket for the lamp.

Figure 3:
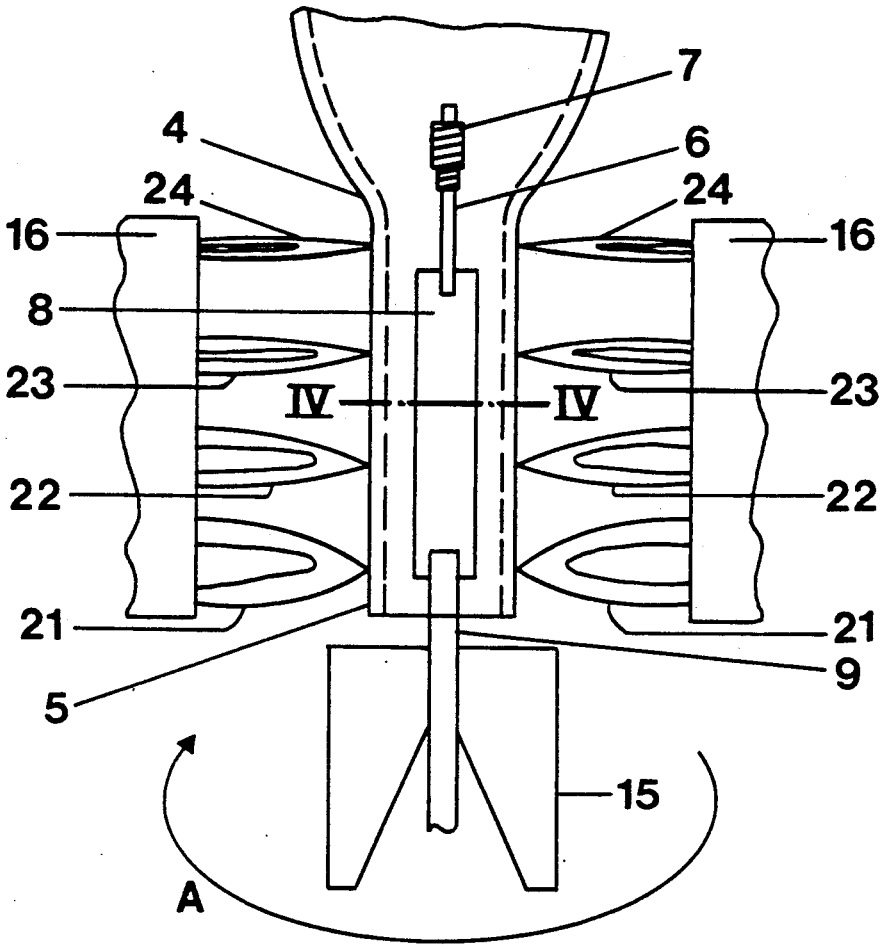
FIG. 3 is a schematic fragmentary vertical view through the lamp shaft and illustrating heating thereof.

The reflector R is shown removed from the lamp for illustration, although it could be physically close to one of the end regions 4 of the discharge vessel, with a central opening to permit passage of one of the shaft-like extensions 5, see FIG. 3 of the referenced U.S. Pat. No. 4,686,419, the disclosure of which is hereby incorporated by reference.

The discharge vessel 2 retains a fill of argon, forming a striking or ignition gas and mercury as the main component. Typically, the vessel 3 of the dimensions given may retain 220 mg of mercury and for each cubic centimeter of discharge volume, the rare earths $DyBr_3$ (1 μmol) and $TmBr_3$ (0.5 μmol), and further 1 μmol TlBr, 2 μmol CsBr and 0.5 μmol $ThI_4$. The thorium may be replaced by hafnium. This fill results in a color temperature of about 5600 K, with a color rendering index Ra of 92, in range 1*a*. The above rare-earth fill provides for a color coordinate position of x=0.3325, y=0.3460.

A supply voltage of 380 V provides for an arc voltage of 210 V and a lamp current of 10.3 A. The losses in the region of the pinch or press seal are substantially reduced with respect to prior art lamps. The resistance of the connections through the pinch or press seal in accordance with the present invention, at 400° C., will be 0.021 ohms; in prior art lamps, the resistance at 400° C. was 0.043 ohms. The higher resistance, resulting in higher losses, was due to the substantially longer extent of the melted-in element between the electrode and the base end or cable or connection, namely about twice the length. Further, the currents in prior art lamps were substantially higher, in the order of 17–25 A. Since the heating losses rise with the square of the current, a reduction in current of a factor of two results in a decrease in heat losses by a factor of four.

The overall structure of the 2000 W lamp of FIG. 1 thus permits increase of the overall light output to 105 1 m/W, while at the same time obtaining the lifetime of about 2000 hours. The specific arc power is 67 W/mm.

The discharge vessel is essentially isothermal and has a maximum vessel temperature at a hot spot of about 1030° C. The temperature drops to a cold spot, behind the electrodes and at the end portions 4 of the vessel, to about 1000° C. At the connecting or base end of the foils, the temperature has dropped to 250°, when the lamp is operating in free ambient surroundings. Located within a flood light reflector structure, the temperature may rise to 350° C. in dependence on the construction of the fixture, or reflector, with which the lamp is associated.

Experiments with different lengths of foils in a 2000 W lamp dramatically show the decrease in temperature to which the lamp is subjected:

A foil length of 20 mm resulted in an end temperature adjacent the base of the foils of 400° C. Increasing the length of the foil by 25%, so that the foil will have a length of 25 mm, the temperature was only 265° C. Further extension of the foil by 5 mm, to an overall length of 30 mm, resulted in a decrease of the temperature at the remote or base end of the foil by an additional 20° C., to a final temperature of 245° C. A further decrease in temperature can be obtained by sandblasting the shaft-like extensions 5 to increase heat dissipation, so that they will be frosted; by frosting the extensions, a further temperature decrease by about 50° C. is obtained.

Figure 2:
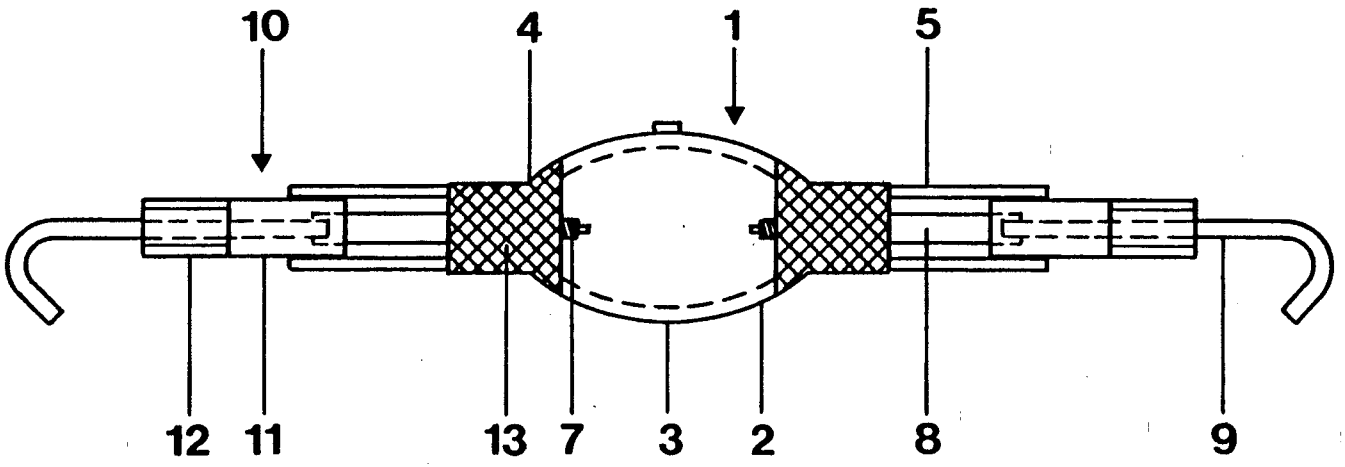
FIG. 2 is a view similar to FIG. 1 of a high-pressure discharge lamp of 1000 W rating.

FIG. 2 illustrates an example of a 1000 W lamp which, basically, is similar to the 2000 W lamp and has identical dimensions. The same reference numerals have been used for similar lamp components. This lamp has a supply voltage of 220 V, with an operating current of 10.3 A. To obtain, with these specifications, the temperatures necessary for optimum vapor pressure within the lamp, the ends of the discharge vessels are coated with a zirconium oxide ($ZrO_2$) coating 13 for heat retention or heat damming. The fill contains the same components except that the iodine-bromine ratio is shifted to provide some more iodine.

The fill of the lamp may contain other metal halides, such as NaI or ScI, which will result in different color temperatures. The chromaticity coordinates can be varied within some limits by suitable and careful selection of the iodine-bromine relationship.

To make the lamp, initially a cylindrical quartz tube of a wall thickness of 2 mm is supplied. The ellipsoid-like or barrel-like shape of the discharge vessel is made under computer control. Increase of the wall thickness within the central region is obtained by compression of the glass while it is soft. The essentially flat pinch seal is made by careful control of the temperature while rotating flames about the extension portions 5.

Referring now to FIG. 3, which shows the apparatus to heat the portion 5 of the bulb for pinch-sealing. Raw bulb is placed in a vertical holder. The electrode system includes the current supply connection 9, the foil 8, and the electrode 6. The electrode assembly formed of elements 6–9 is held in a holder 15 and introduced in shaft 5, from below. The lamp bulb extension 5, with the electrode assembly 6–9 therein, is then heated, starting from the lower portion and successively to the top, by using two oppositely located gas burners 16, projecting a plurality of flames 21, 22, 23, 24. Two gas burners 16 as shown in the drawings heat shaft 5 to the temperature required for pinch-sealing. As soon as the region of the extension 5 closest to the discharge bulb, that is, the region 4, has reached the required softening temperature of the glass, a pair of pinch jaws, well known and not shown since any suitable construction may be used, are applied against each other to form an essentially flat pinch seal. In the position of the foil 8, the pinch jaws will operate transversely to the plane of the drawing.

The two gas burners are rotated about the axis of the lamp shaft, see arrow A, and by use of differently shaped and sized flames, as shown in FIG. 3, can generate a very uniform temperature of the glass of 2300° C.±50° C. This is obtained by optimizing the profile of the gas flame. Four gas nozzles of different nozzle diameters are suitable. The nozzle diameter generating the widest or biggest flame 21 is located at the end of the shaft extension 5.

After formation of the first pinch seal, the bulb is reversed so that the still open extension 5 will be at the bottom. The above-described process is then repeated.

The method with non-uniform heating has this advantage: simultaneous uniform heating of the entire lamp shaft may cause the lamp shaft to wobble and thus interfere with adjusted position of the electrode system within the bulb. Successively strong heating, however, prevents wobble which may occur only when the shaft is softened, and that is just as the jaws will close.

The arrangement also solves the problem that the lamp extension 5, due to its own weight, might elongate and, in the course of hanging down, might change the wall dimension. This problem does not arise in short pinch seals where surface tension holds the softened glass of the lamp shaft together or even shortens the lamp shaft, so that simultaneous heating of the entire lamp shaft portion 5 is feasible.

Precise positioning of the electrode system is ensured by slightly bending the molybdenum foil before introducing the foil into the originally circular shaft 5. The foil 8 can be bent in V shape, or U or channel shape, with one or more longitudinal creases or bends. The thickness of the foil preferably is below 0.05 mm. Stiffening the foil 8 by a longitudinal crease or bend is sufficient to properly position even extremely long foils, that is, foils in the order of 3 cm, can be placed in the shaft extension 5 while providing for precise alignment and positioning of the electrode 7 within the bulb 1. During pinch sealing, and under the influence of the oppositely acting pinch jaws, any crease or deformation of the foil 8 is eliminated and the foil 8 is flattened.

Figure 4A:
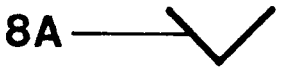
FIGS. 4A and 4B are highly schematic cross-sectional views along the fragmentary section line IV—IV of FIG. 3, and illustrating two embodiments of shaping the molybdenum foil to provide for positioning thereof in the lamp bulb extension during manufacture.
Figure 4B:
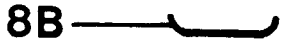

FIGS. 4*a* and 4*b*, schematically, show the foil 8A, 8B in cross section along line IV—IV of FIG. 3, to illustrate the V-shaped or generally U or channel-shaped deformation thereof, prior to moving the sealing jaws against the heated glass of the extension 5.

By providing gas burners projecting a plurality of flames 21–24 of different and successively broader flame profile with the flame 24 closest to the bulb being essentially pencil-shaped and broadening out towards the end portion of the shaft extension, from opposite sides of the shaft while rotating the flames about the axis of the lamp, essentially uniform heating can be obtained, without danger of deformation, or cracking, while ensuring placement of the electrodes within the bulb in a desired position.

The dimensions given above for the exemplary embodiments are not critical; for example, the lengths of the foils 8 may be about 60–80 % of the length of the shaft-like extension 5; the thickness of the molybdenum foils, in the central region, is preferably about 2°/₀₀, that is 0.002, of the length of the foil. The specific power defined as the nominal power to electrode spacing of the lamp can be about 30–70 W/mm, which will result in lamps of between 1–4 kW rating in electrode spacings of about 28–32 mm, and a wall loading in the order of 30–60 W/cm$^2$. The wall thicknesses of the discharge vessel of quartz glass can be between 2–3 mm, with the wall thickening by a factor of 1.2 to 1.4 from the end regions 4 towards the central region 3.

We claim:

1. A high-pressure high-power discharge lamp suitable for power ratings of about 1 kW or more, having a high-wall loading, especially adapted for use in an optical system (R) and suitable for operation devoid of an outer bulb, said lamp having a unitary elongated discharge vessel (2) directly exposed to said optical system, said discharge vessel comprising a high temperature-resistant, light transmissive material;

at least one shaft-like extension (5) projecting from an end portion of said vessel and made from the same material as said discharge vessel;

a fill including mercury, at least one noble gas, and at least one metal halide in said vessel (2);

two electrodes (6, 7) located within said vessel, at least one electrode being secured in position in said at least one shaft-like extension (5);

base means (10, 11, 12), at least one base means being located at a remote end of the at least one shaft-like extension (5);

current connection means (9) extending outwardly from the base means;

and at least one connection foil (8) located within said at least one shaft-like extension (5) and electrically connecting an associated current connection means (9) at a remote end of the shaft-like extension with the respective electrode extending from said shaft-like extension into said vessel, and comprising an arrangement to reduce the temperature of the at least one connection foil (8), in operation of the lamp, at a position adjacent the respective base means to a maximum of about 350° C., said arrangement being characterized in that said at least one shaft-like extension (5) comprises a pinch seal sealing said at least one connection foil (8) therein, said pinch seal having a length which is a major fraction of the length of the elongated discharge vessel; and further characterized in that the length of the at least one connection foil (8) extends over a major portion of the length of the shaft-like extension (5) projecting from an end portion of the vessel in which it is sealed.

2. The lamp of claim 1, wherein the length of the shaft-like extension (5) is between about ⅔ and 4/3 of the length of the discharge vessel.

3. The lamp of claim 1, wherein, for a lamp having a rating of between about 1 to 2 kW, the pinch seal has a length of about 4 cm, and the discharge vessel (2) has a length of about 5 cm.

4. The lamp of claim 1, wherein the length of the connection foil (8) is about 60–80% of the length of the shaft-like extension.

5. The lamp of claim 4, wherein the thickness of the connection foil (8), in a central region thereof, is about $2^{\circ}/_{\circ\circ}$(0.002) of its length.

6. The lamp of claim 1, wherein the specific arc power is between about 30 to 70 W/mm, wherein specific power is defined as the ratio of nominal power to spacing of the tips of the electrodes within the vessel (2) from each other.

7. The lamp of claim 1, wherein the spacing of the tips of the electrodes within the discharge vessel (2) is between about 28 to 32 mm.

8. The lamp of claim 1, wherein the wall loading of the lamp is about 30 to 60 $W/cm^2$.

9. The lamp of claim 8, wherein the wall thickness of the discharge vessel is between about 2 to 3 mm.

10. The lamp of claim 9, wherein the wall thickness increases from a position at an end region of the elongated discharge vessel towards a central region thereof by a factor of between 1.2 to 1.4.

11. The lamp of claim 1, wherein the shape of the discharge vessel is, generally, ellipsoid-like or barrel-like.

12. The lamp of claim 1, wherein, to obtain a color temperature similar to daylight, the fill includes two halides of rare earths in combination with cesium and thallium.

13. The lamp of claim 12, wherein the fill additionally contains at least one of: thorium halide; hafnium halide.

14. The lamp of claim 1, wherein, per cubic centimeter of volume of the discharge vessel (2), the fill includes 1 μmol $DyBr_3$, 0.5 μmol $TmBr_3$, 1 μmol TlBr, 2 μmol, CsBr and 0.5 μmol $ThI_4$.

15. The lamp of claim 1, wherein said lamp is a double-ended lamp having two shaft-like extensions projecting from opposite end portions of said elongated discharge vessel, and unitary therewith, each of said shaft-like extensions having a respective base (10, 11, 12) and a current connection means (9) extending therethrough, each said shaft-like extension including said arrangement to reduce foil temperature of each of the shaft-like extensions, each of said shaft-like extensions including a respective connection foil (8) and a pinch seal retaining said connection foil.

16. The lamp of claim 1, wherein the portion (6') of the electrode embedded in the pinch seal (5) is very short.

17. The lamp of claim 16, wherein said portion (6') has a length of less than 4 mm.

18. The lamp of claim 1, wherein each shaft-like extension has a length which is a major portion of the discharge vessel - extension combination.

19. The lamp of claim 1, wherein said pinch seal, in cross section, is essentially double-T or I shaped.

20. The lamp of claim 1, wherein said pinch seal is essentially flat.

21. A method of making a double-ended high-pressure discharge lamp comprising furnishing a unitary elongated discharge vessel (7) of high-temperature resistant, light transmissive material having two shaft-like extensions (5) projecting from opposite end portions of the vessel and vertically holding said vessel;

providing an electrode subassembly comprising a current connection lead (9), an elongated connection foil (8) electrically and mechanically connected at one end to said current connection lead (9), and an internal electrode (6, 7) electrically and mechanically connected to the other end of said elongated connection foil (8), holding the electrode subassembly externally of the discharge vessel in a holder (15) and positioning the internal electrode within the discharge vessel in a predetermined location by vertically introducing said subassembly into the discharge vessel through one of the shaft-like extensions (5);

heating the shaft-like extensions into which the subassembly is introduced by rotating a heater unit (16, 21-24) about the shaft-like extension, and transmitting heat, to apply heat from said heater unit towards said shaft-like extension in which the applied heat is non-uniform with respect to the longitudinal extent of the shaft-like extension and provides highest heating at a location remote from a juncture (4) of said shaft-like extension with the discharge vessel (2);

continuing to heat the shaft-like extension until said high-temperature resistant light transmissive material softens;

and moving pinch jaws having a longitudinal extent at least approximately commensurate with the longitudinal extent of said heated, softened shaft-like extension (5) thereagainst to deform said extension and form a pinch seal.

22. The method of claim 21, wherein said heater unit comprises a gas burner (16) projecting a plurality of flames (21-24) towards said shaft-like extensions with different flame profiles, in which the flame profile of the flame (21) closest to the end of the shaft-like extension (5) remote from said juncture (4) is broad and has a high heat content;

and the profiles of the flames (22, 23, 24) sequentially closer to said juncture are successively narrower than said broad flame and narrow to an essentially pencil-like flame (24) projected closest to said juncture (4).

23. The method of claim 21, wherein said step of heating said shaft-like extension comprises projecting said flames from opposite sides of said shaft-like extensions by two burners, and rotating said burners about the shaft-like extension to provide for essentially uniform heating thereof.

24. The method of claim 21, wherein said foil (8A) of the electrode subassembly, upon introduction into said vessel, is formed with a longitudinal crease to provide, in cross section, shallow V or roof shape;

and said pinch sealing step comprises flattening the foil.

25. The method of claim 21, wherein said foil (8B) of the electrode subassembly is, in cross section, U or channel-shaped;

and said pinch sealing step comprises flattening the foil.

26. The method of claim 21, wherein, first, the step of introducing said electrode into the shaft-like extension, heating and pinch sealing is carried out on one of said shaft-like extensions; and the steps of claim 21 are then repeated by introducing a second electrode subassembly into the other shaft-like extension, and then heating and pinch sealing the other shaft-like extension.

27. The method of claim 21, wherein said electrode subassembly is introduced from below into the shaft-like extension.

28. The method of claim 21 wherein the step of transmitting heat from the heater unit (16, 21–24) comprises projecting flames (21–24) toward the shaft like extension, which flames are non-uniform with respect to the longitudinal extent of said shaft like extension.

29. The method of claim 21, wherein the length of the shaft-like extension (5) is between about $\frac{2}{3}$ and 4/3 of the length of the discharge vessel.

30. The method of claim 21, wherein each shaft-like extension has a length which is a major portion of the discharge vessel - extension combination.

* * * * *